US007441370B2

(12) United States Patent
Muller

(10) Patent No.: US 7,441,370 B2
(45) Date of Patent: Oct. 28, 2008

(54) ADJUSTABLE AND MODULAR SECURITY APPARATUS FOR PROTECTION OF DOOR AND WINDOW OPENINGS

(75) Inventor: Mauro Muller, San Diego, CA (US)

(73) Assignee: Ricardo Guerra Asunsolo, Col. San Miguel Chapultpee (MX)

( * ) Notice: Subject to any disclaimer, the term of this patent is extended or adjusted under 35 U.S.C. 154(b) by 0 days.

(21) Appl. No.: 10/986,226

(22) Filed: Nov. 12, 2004

(65) Prior Publication Data

US 2005/0081446 A1 Apr. 21, 2005

Related U.S. Application Data

(62) Division of application No. 10/143,977, filed on May 14, 2002.

(51) Int. Cl.
*E06B 3/68* (2006.01)

(52) U.S. Cl. ..... 49/57; 49/463; 49/55

(58) Field of Classification Search ..... 49/50, 49/55, 57, 463

See application file for complete search history.

(56) References Cited

U.S. PATENT DOCUMENTS 683,217 A * 9/1901 Mower ..... 49/55
1,662,117 A * 3/1928 Kuhl ..... 49/57
2,803,471 A * 8/1957 Roth ..... 280/748
3,593,474 A 7/1971 Neels
3,807,681 A 4/1974 Kane et al.
4,371,139 A 2/1983 Clark
4,400,911 A * 8/1983 Bell et al. ..... 49/55
4,437,265 A * 3/1984 Turro et al. ..... 49/57
4,671,012 A * 6/1987 Merklinger et al. ..... 49/55
4,837,974 A * 6/1989 Jokel ..... 49/55
5,031,724 A 7/1991 Quinn
5,062,871 A 11/1991 Lemon, III
5,253,839 A 10/1993 McClure
5,283,976 A * 2/1994 La Mont ..... 49/55
5,314,156 A 5/1994 Moses
5,339,567 A * 8/1994 Pierpont et al. ..... 49/55
5,446,996 A * 9/1995 Lamont ..... 49/57
5,613,658 A 3/1997 Rogelja
5,617,698 A 4/1997 Guilmette
5,697,742 A 12/1997 House
5,704,164 A * 1/1998 Huang ..... 49/55

(Continued)

FOREIGN PATENT DOCUMENTS

DE 4205621 10/1993

(Continued)

*Primary Examiner*—Gregory J. Strimbu
(74) *Attorney, Agent, or Firm*—Sughrue Mion, PLLC

(57) ABSTRACT

An adjustable apparatus for protection of a door or window opening having an upper frame and a lower frame. The adjustable apparatus includes a plurality of posts, a first end plate for fastening a first end of the adjustable apparatus to the upper frame of the opening, and a second end plate for fastening a second end of the apparatus to the lower frame of the opening. Each of the plurality of posts further includes a first portion having a predetermined length and a second portion having a predetermined length, wherein the first portion telescopically engages the second portion. A length of the plurality of posts telescopically adjusts to correspond to a longitudinal dimension between the upper frame and the lower frame of the opening.

9 Claims, 10 Drawing Sheets

U.S. PATENT DOCUMENTS 5,913,783 A 6/1999 Weener et al.
5,979,854 A 11/1999 Lundgren et al.
6,141,912 A * 11/2000 Graham et al. ..... 49/465
6,213,434 B1 4/2001 Reichanadter, Jr.
6,405,497 B1 * 6/2002 Christopolous ..... 52/202
6,554,235 B1 4/2003 Fortier

FOREIGN PATENT DOCUMENTS

DE 19730932 1/1999
JP 303414 11/1999

* cited by examiner

ADJUSTABLE AND MODULAR SECURITY APPARATUS FOR PROTECTION OF DOOR AND WINDOW OPENINGS

This is a divisional of application Ser. No. 10/143,977 filed May 14, 2002. The entire disclosure of the prior application, application Ser. No. 10/143,977 is considered part of the disclosure of the accompanying Divisional application and is hereby incorporated by reference.

BACKGROUND OF THE INVENTION

The present invention relates to an apparatus for the protection of door and window openings; more particularly, to an improved adjustable security apparatus for the protection of door and window openings; and even more particularly, to an improved security apparatus for the protection of door and window openings that is capable of extending telescopically to adjust to any door or window size.

In the construction of residential and commercial homes and buildings, openings for doors and windows are framed in the building structure. Next, door and window fixtures are installed in these framed openings. If security is required and the door or window itself does not already include its own security protection, a grill or similar protection device will be installed in the door or window opening. These conventional grills or similar protection devices must be manufactured according to the specific size of the door and window openings in which they will be installed, resulting in increased costs and longer delivery lead times. In addition, these structures cannot be removed and installed in different door or window openings without modification, unless the new door or window opening is the same size.

Several conventional security structures have attempted to solve some of these problems. For example, U.S. Pat. No. 5,492,164 (Gist) discloses a folding structure which extends across the window width and is secured to opposing guide elements. This system has a cover that is attached to the lower sash of the window. Several horizontal blocking rods are positioned under the cover. Each end of the horizontal blocking rods is positioned in the opposing guide elements. As the window is raised, the cover rises with it, followed by several horizontal blocking rods, which are lifted upwards in the guide elements. The blocking rods are positioned laterally across the opening of the window and are designed to prevent egress of children and pets through the open window. When the window is closed, the blocking rods are retracted and covered by the cover at the base of the window. However, because the rods retract, this system does not provide any security or protection when the window is closed. In addition, this system only protects the opening below the window when the window is in an open position. It does not protect the entire window area neither when the window is in the open position nor the closed position. Further, this system is not applicable to both doors and windows.

U.S. Pat. No. 649,136 (Mockel) is another example of the conventional security apparatus. Mockel also relates to a guard adapted to prevent children or inanimate objects from falling out of a window. The guard is composed of a pair of uprights and a plurality of horizontal connecting bars or bands pivotal about points on one of the uprights so that they may be folded up along one side of the window. However, Mockel, as with Gist, only protects the lower portion of the window using horizontal bars.

U.S. Pat. No. 5,910,076 (Gladney) discloses another conventional apparatus for security of doors and windows employing a security grill having an extending left section and right section. The left section includes a left vertical support member, a plurality of lateral support members, and the plurality of vertical bars attached to and supported by the lateral support members. In addition, Gladney discloses a plurality of intermediate lateral extension members that are each inserted into a corresponding pair of left and right tubular lateral support members and are slidable therein to allow the horizontal extension of the left security grill section with respect to the right security grill section. However, Gladney does not permit vertical adjustability.

Another example of the conventional security apparatus is shown in U.S. Pat. No. 5,943,832 (Russell). Russell discloses a flood or storm resistant barrier for a doorway or window opening. The barrier is formed of a frame having two parts with one part in telescopic engagement with the other frame part. In addition, Russell discloses a manually operable jack in the form of four links that are pivotally connected to form a parallelogram linkage which is inserted between the two frame parts. The jack is operated to move the frame parts laterally relative to one another so as to vary the horizontal dimensions of the frame and enable the frame to be secured across the horizontal dimension of the doorway or window opening. A waterproof barrier member is carried by the frame for blocking the portion of the doorway or window opening. However, as with the other conventional apparatus, Russell does not permit vertical-adjustability.

In yet another example of the conventional security apparatus, U.S. Pat. No. 5,916,074 (Tracy) discloses a window guard for mounting in or on a window to protect children and objects from falling out of the window. A first wire subassembly and a second wire subassembly are interconnected along side of each other by metal clamps that allow each subassembly to slide with respect to the other subassembly and thereby allow the window guard to fit many different sized horizontal openings. Tracy also does not permit vertical adjustability.

As described above, the conventional security apparatus lack versatility and are limited in their application because they are limited to specific door or window sizes. Moreover, the conventional security apparatus are not easily adjustable to cover the entire window or door openings. In addition, the conventional security apparatus are not adjustable both vertically and horizontally. Furthermore, these conventional security apparatus are not easily installed, removed, and reinstalled. The conventional security apparatus doe not permit universal installation and application from one location to another location, which has a different size. It is therefore desirable to have a security apparatus for protection of door and window openings that is capable of extending telescopically to easily adjust to any door or window size to provide protection of the entire door or window area.

SUMMARY OF THE INVENTION

It is therefore an aspect of the present invention to provide an adjustable security apparatus for protection of door and window openings.

It is another aspect of the present invention to provide an adjustable security apparatus for the protection of door and window openings that is capable of extending telescopically in a longitudinal direction to adjust to any door or window size.

It is a further aspect of the present invention to provide an adjustable security apparatus for protection of door and window openings that can be easily installed or removed from an existing door or window frame opening.

It is yet another aspect of the present invention to provide an adjustable security apparatus for protection of door and window openings that can be easily and efficiently installed, removed, and reinstalled in a different window frame or opening by vertically extending the adjustable security apparatus telescopically.

It is still another aspect of the present invention to provide a modular adjustable security apparatus for protection of door and window openings that can be installed, along with a plurality of similar modular adjustable security apparatus, in order to provide security over the entire area of a door or window opening.

It is yet another aspect of the present invention to provide an adjustable security apparatus for doors and windows that is constructed of a minimal number of parts, that is easily installed, removed, and reinstalled in a variety of door and window openings either temporarily or permanently, and that maintains an aesthetically pleasing appearance that does not detract or distract from its surroundings.

It is a further aspect of the invention to provide an adjustable security apparatus that minimizes the obstruction of a persons view through a window or door opening.

Further aspects, features and advantages of the invention may become apparent from the consideration of the following description and the appended claims when taken in connection with the accompanying drawings.

BRIEF DESCRIPTION OF THE DRAWINGS

The above aspects and advantages of the present invention will become more apparent by describing in detail illustrative, non-limiting embodiments thereof with reference to the attached drawings, in which:

FIG. 8B shows a reinforcing embodiment with an end plate.

DETAILED DESCRIPTION OF ILLUSTRATIVE EMBODIMENTS OF THE INVENTION

Hereinafter, illustrative, non-limiting embodiments of the present invention will be described in detail with reference to the attached drawings. The present invention is not restricted to the following illustrative embodiments, and many variations are possible within the spirit and scope of the present invention. Illustrative embodiments of the present invention are provided in order to more completely explain the present invention to one skilled in the art.

Illustrative embodiments of an improved adjustable security apparatus for protection of door and window openings that solves the aforementioned problems, and others, are now described with reference to FIGS. 1-9.

The present invention relates to an adjustable security apparatus for doors and windows that is capable of extending telescopically to adjust to any door or window size, and thereby, prevent access into the door or window.

Figure 1:
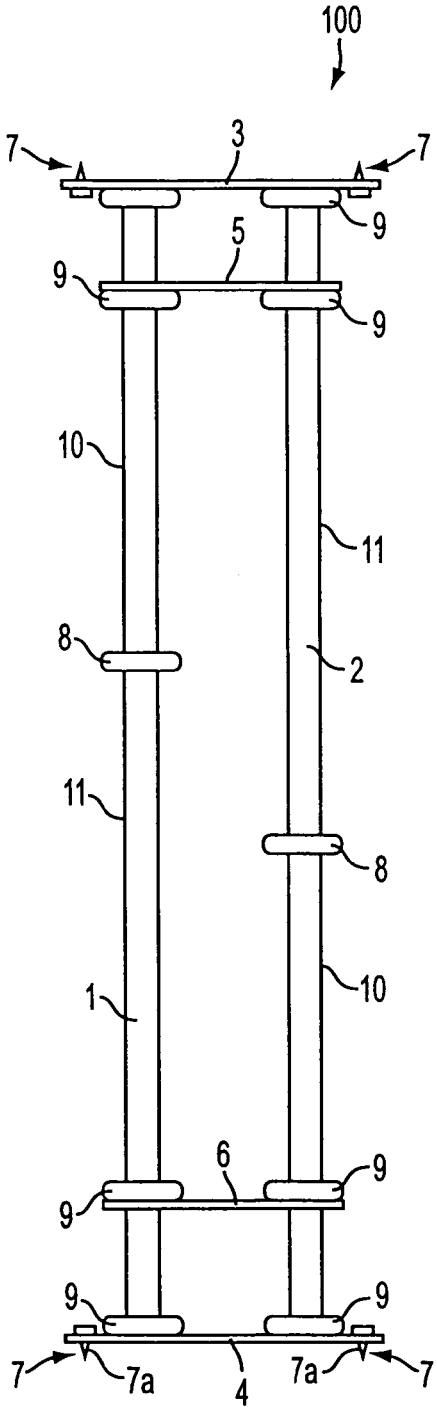
FIG. 1 is a side view depicting an adjustable security apparatus for protection of door and window openings, according to an illustrative, non-limiting embodiment of the present invention.

As shown in FIG. 1, in an illustrative embodiment of the present invention, the adjustable security apparatus comprises an adjustable module 100. The module 100 preferably comprises, but is not limited to, at least two vertical posts 1, 2. Additional modules 100 can be installed adjacent to the first module in order to adequately protect the entire lateral area of the door or window opening.

Figure 2:
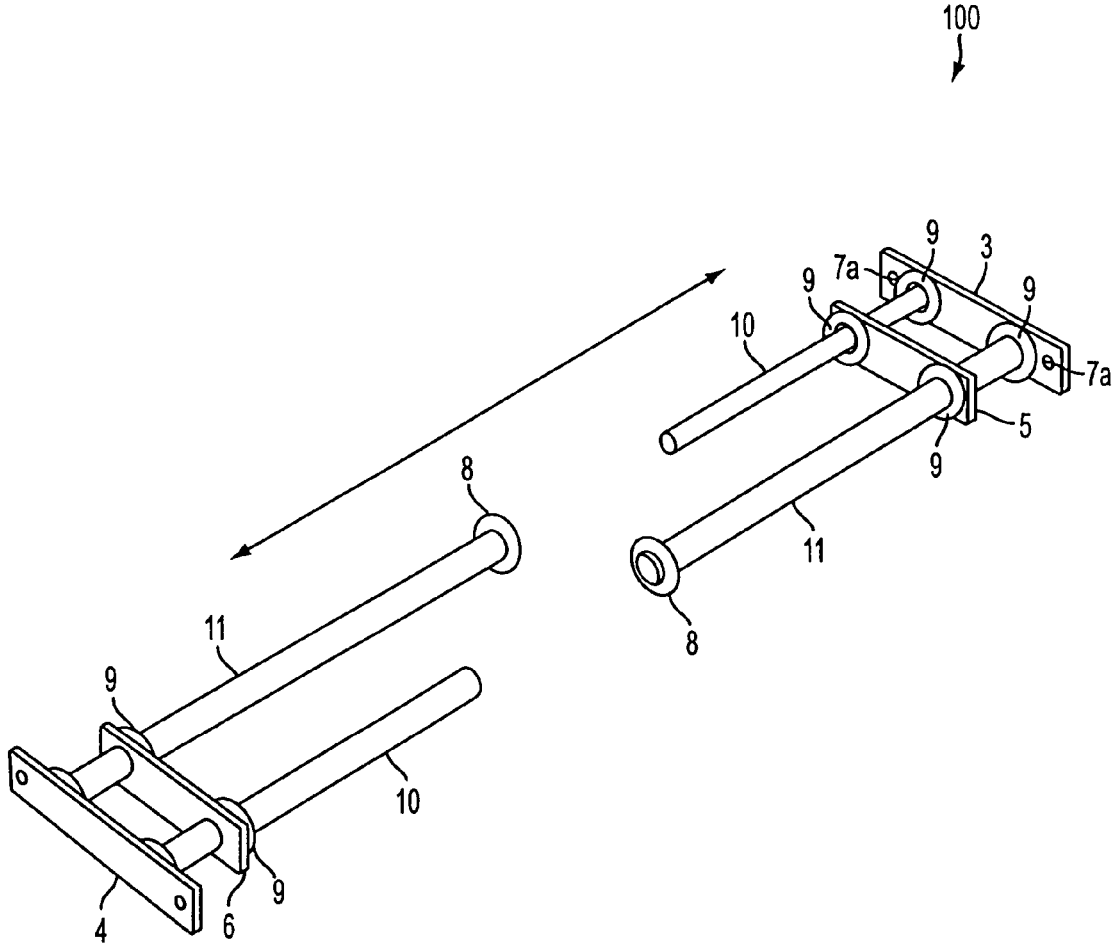
FIG. 2 is an exploded view of an adjustable security apparatus for protection of door and window openings, according to an illustrative, non-limiting embodiment of the present invention.

Specifically, with reference to FIGS. 1 and 2, the module 100 comprises two posts 1, 2. The posts 1, 2 are preferably, but not necessarily, substantially the same length. As shown in FIGS. 1 and 2, each post 1, 2, comprises a first portion 10 and a second portion 11. The first portion 10 is telescopically disposed within the second portion 11.

The second portion 11 has an inner diameter, or dimension, so that the second portion 11 can telescopically receive the first portion 10, which has a smaller outside diameter or dimension. Other embodiments can include posts 1, 2 that comprise greater than two portions. As shown in the illustrative embodiment depicted in FIG. 2, the first portion 10 and second portion 11 of post 1 are in a reverse orientation to the first portion 10 and second portion 11 of the post 2, so that the strength of the module is substantially the same at both ends. However, depending on the application, the orientation of the portions 10, 11 of posts 1, 2 is not required to be alternated.

Figure 3A:
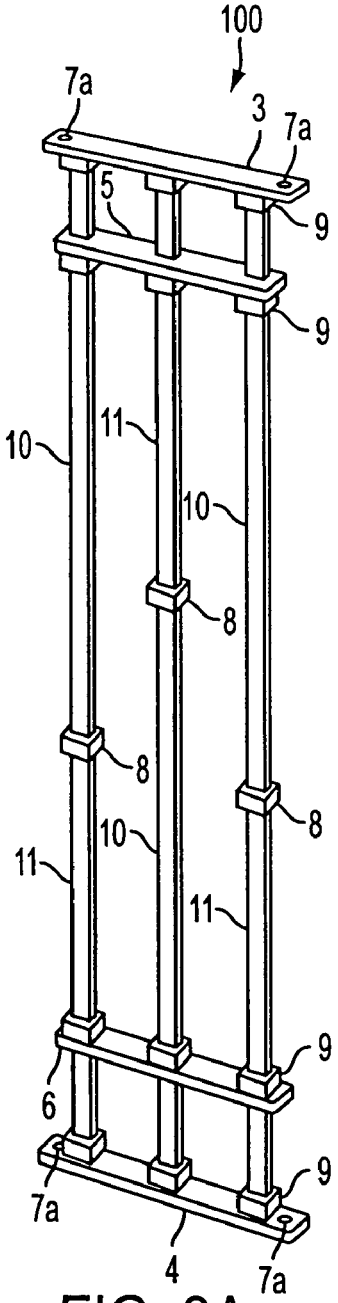
FIG. 3A-3C are perspective views of an adjustable security apparatus for protection of door and window openings, showing three, two and four post designs, respectively, according to yet another illustrative, non-limiting embodiment of the present invention.
Figure 3B:
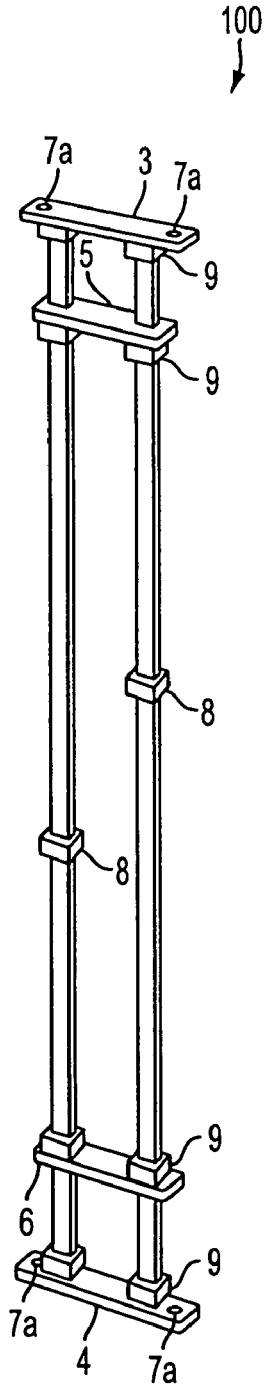
Figure 3C:
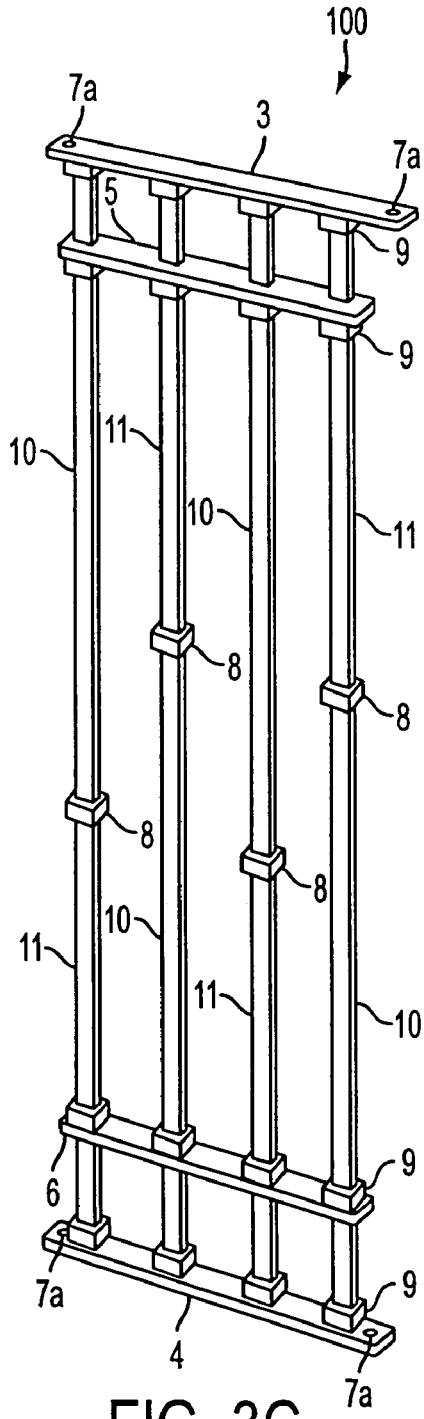

The posts 1, 2 depicted in FIG. 2 are tubular posts. However, the adjustable security apparatus can be formed from posts having various shapes. For example, the security apparatus can comprise posts that are square, round, oval, triangular, rectangular, hexagonal, or various other shapes. FIGS. 3A-3C depict posts 1, 2 having a rectangular or square shape, rather than a circular or tubular shape.

Figure 11:
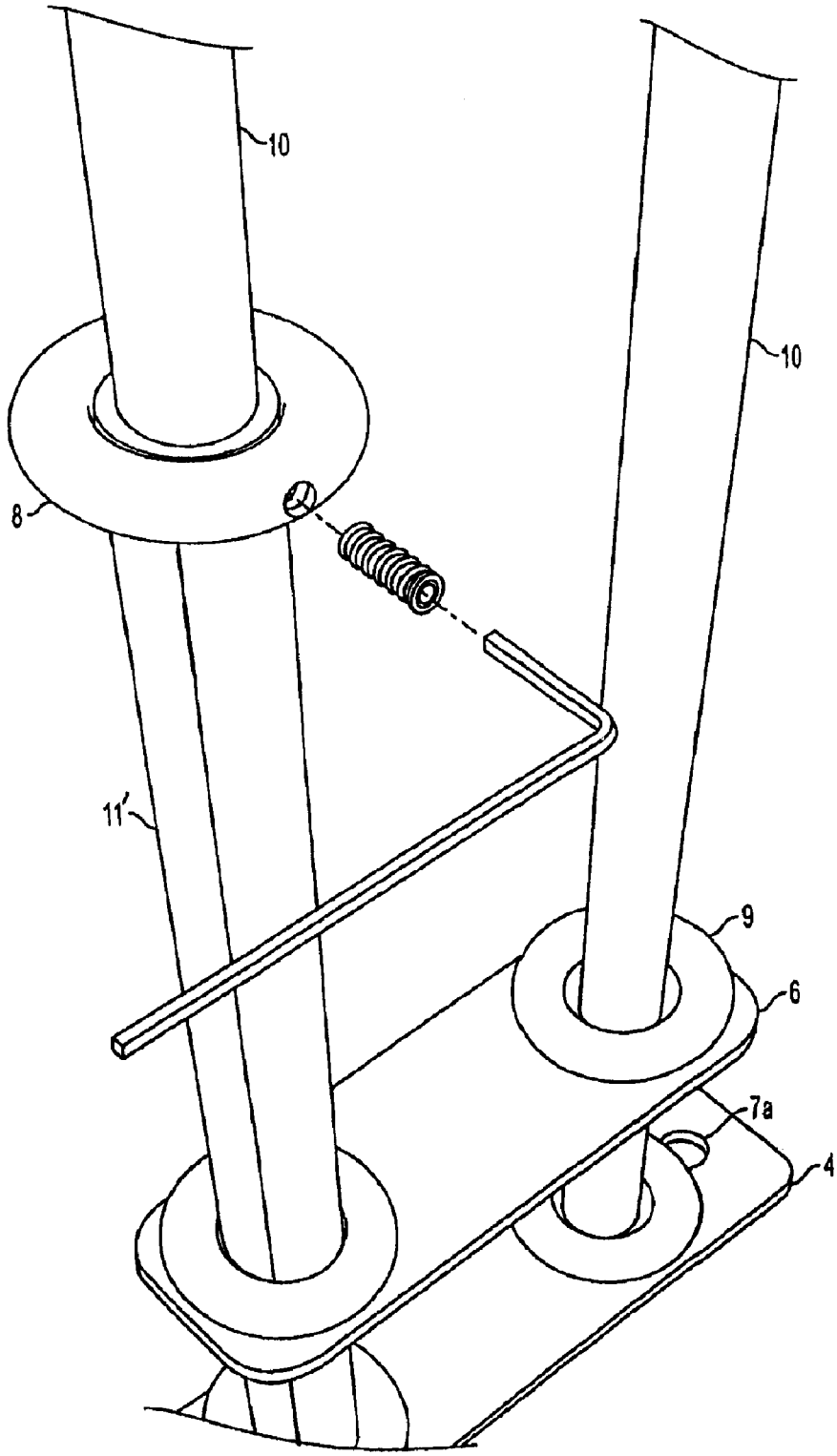
FIG. 11 is a perspective view depicting a means for fixing the adjustable security apparatus according to another illustrative, non-limiting embodiment of the present invention.

Preferably, but not necessarily, the shape of the first portion 10 should correspond to the second portion 11. However, in other illustrative embodiments, the shape of the first portion 10 and second portion 11 do not correspond. In these illustrative embodiments, it is possible to use different shapes so long as the second portion 11 is capable of accepting the first portion 10 in a telescopic manner. For example as shown in FIG. 11, a circular shaped first portion 10 engages a square shaped second portion 11' in a telescopic manner.

Furthermore, the adjustable security apparatus can be formed from a variety of materials suited for this purpose. The module 100 can be formed from any material, or combination of materials, with suitable strength, such as, but not limited to, iron, steel, aluminum, plastics, composite materials, and so on.

Figure 4A:
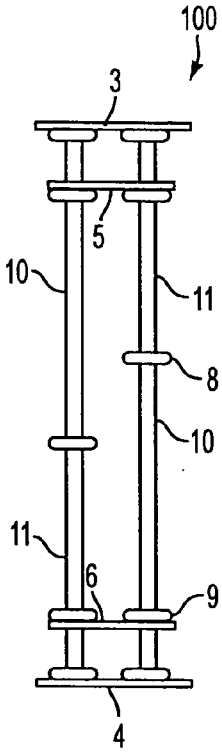
FIGS. 4A-4C are side views of an adjustable security apparatus for protection of door and window openings, showing short, medium and tall heights, respectively, according to an illustrative, non-limiting embodiment of the present invention.
Figure 4B:
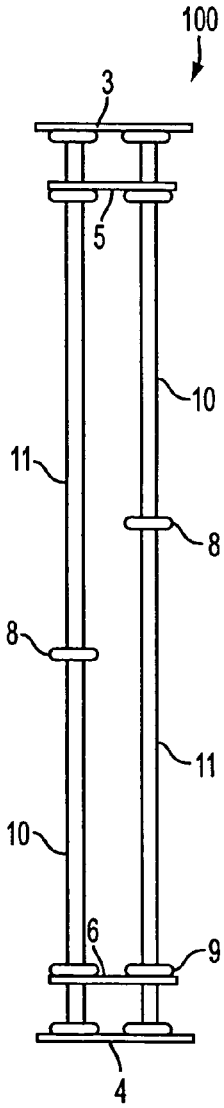
Figure 4C:
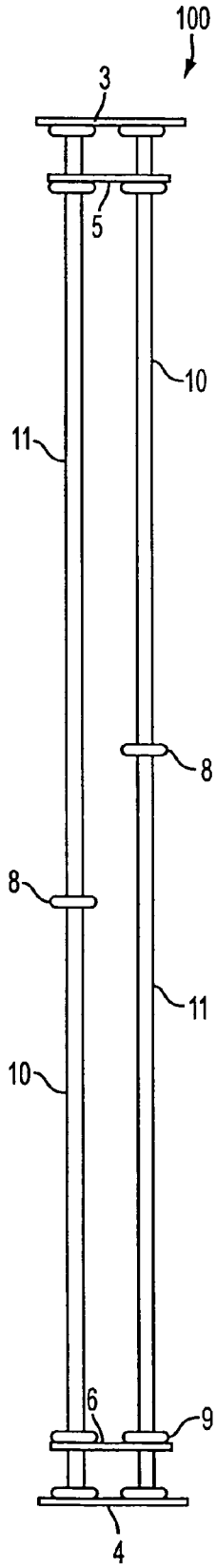
Figure 5A:
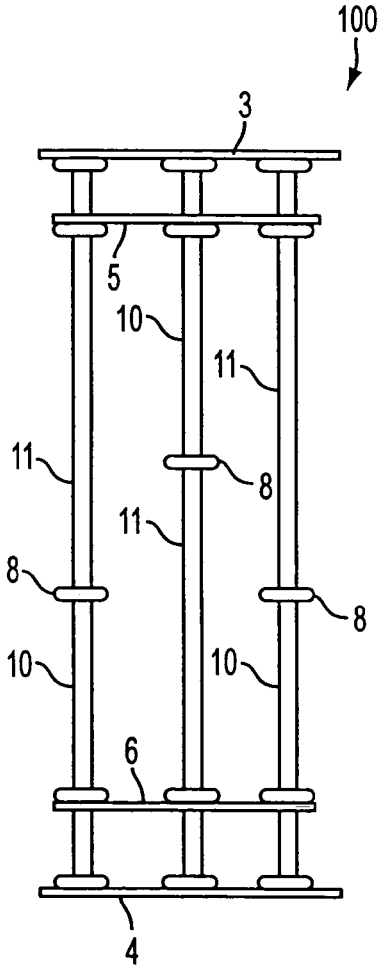
FIGS. 5A and 5B are side views of an adjustable security apparatus for protection of door and window openings, showing three and four post designs, respectively, according to an illustrative, non-limiting embodiment of the present invention.
Figure 5B:
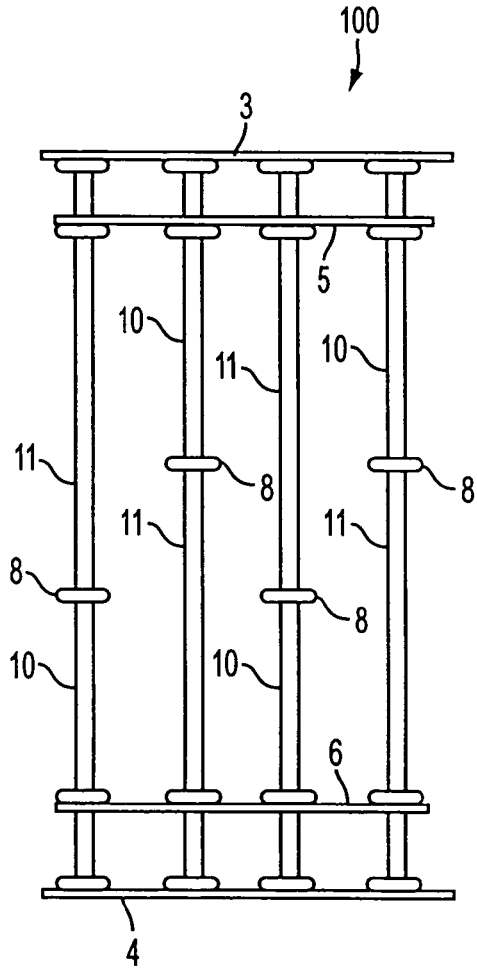

As shown in FIGS. 4A-4C, the first portion 10 and the second portion 11 are axially aligned and overlap one another so that they can be extended telescopically to fill an infinite variety of existing or newly constructed window or door opening sizes. FIGS. 4A-4C depicts other illustrative embodiments having various sizes of posts 1, 2. By simply increasing the length of posts 1, 2, the module can be applied to a wider range of door and window sizes. In addition, more than two posts may be employed such that one module can cover a larger area, as shown in FIGS. 3A, 3C, 5A, and 5B.

The module further comprises a first end plate 3 and a second end plate 4 fixed to either end of the module. The posts 1, 2 are fixed to the end plates 3, 4 so that post 1 is parallel to post 2.

As shown in the Figures, end plate 3 and end plate 4 are used to secure the module to the window or door frame. End plates 3 and 4 can include holes 7*a* for receiving a fastener 7, such as nail (shown), screw, or lag bolt, etc. Preferably, the fastener 7 is a security screw. Other fasteners 7 suitable for this purpose may also be used to secure the end plates 3 and 4 to the door or window frame.

Figure 6A:
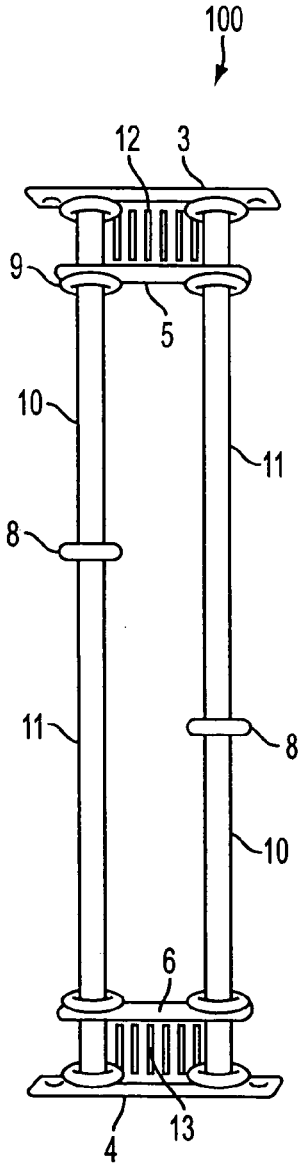
FIGS. 6A-6C are perspective views of an adjustable security apparatus for protection of door and window openings, showing first, second and third transverse bar designs, respectively, according to another illustrative, non-limiting embodiment of the present invention.
Figure 6B:
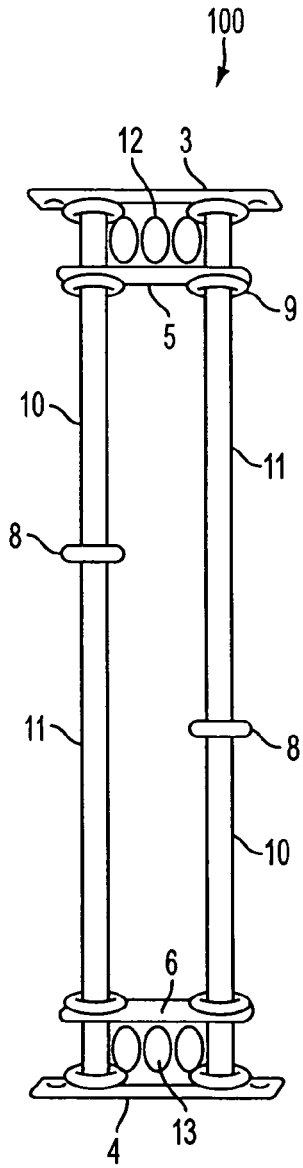
Figure 6C:
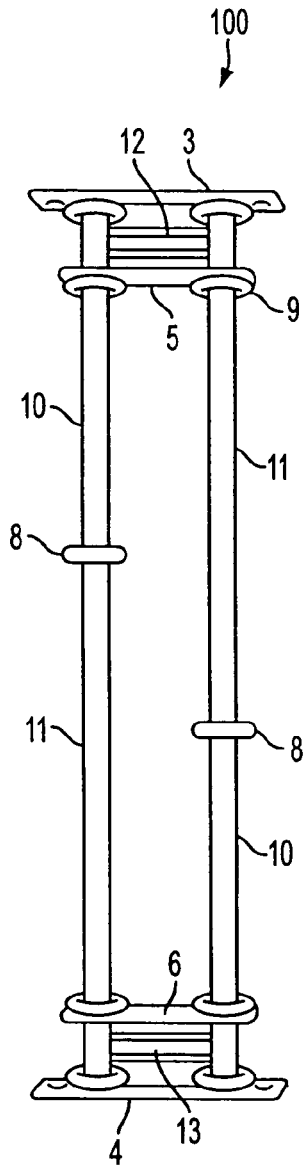

The module can also include a plurality of traversing bars 5, 6 that traverse the posts 1, 2 to provide added strength and rigidity to the module and to aid in maintaining the substantially parallel relationship between the post 1, 2. These traversing bars 5, 6 are preferably disposed towards the ends of the posts 1, 2. However, the traversing bars 5, 6 can also be positioned at various positions along the length of the posts 1, 2 depending on the application of the module 100. The traversing bars 5, 6 can be horizontal plates, as shown, for example, in FIGS. 1 and 2. In addition, the traversing bars 5, 6 can be used alone or in combination with vertical traversing plates 12, 13, as shown in FIG. 6A-6C. The vertical plate traversing bars 12,13 can comprise slits, holes, grooves, or webbing, etc., for reducing the weight of the vertical plate traversing bars 12, 13 while maintaining their strength and, additionally, improving the aesthetic appearance of the module. Further, additional transverse bars (not shown) may also be installed to provide added security and increased strength.

Figure 7:
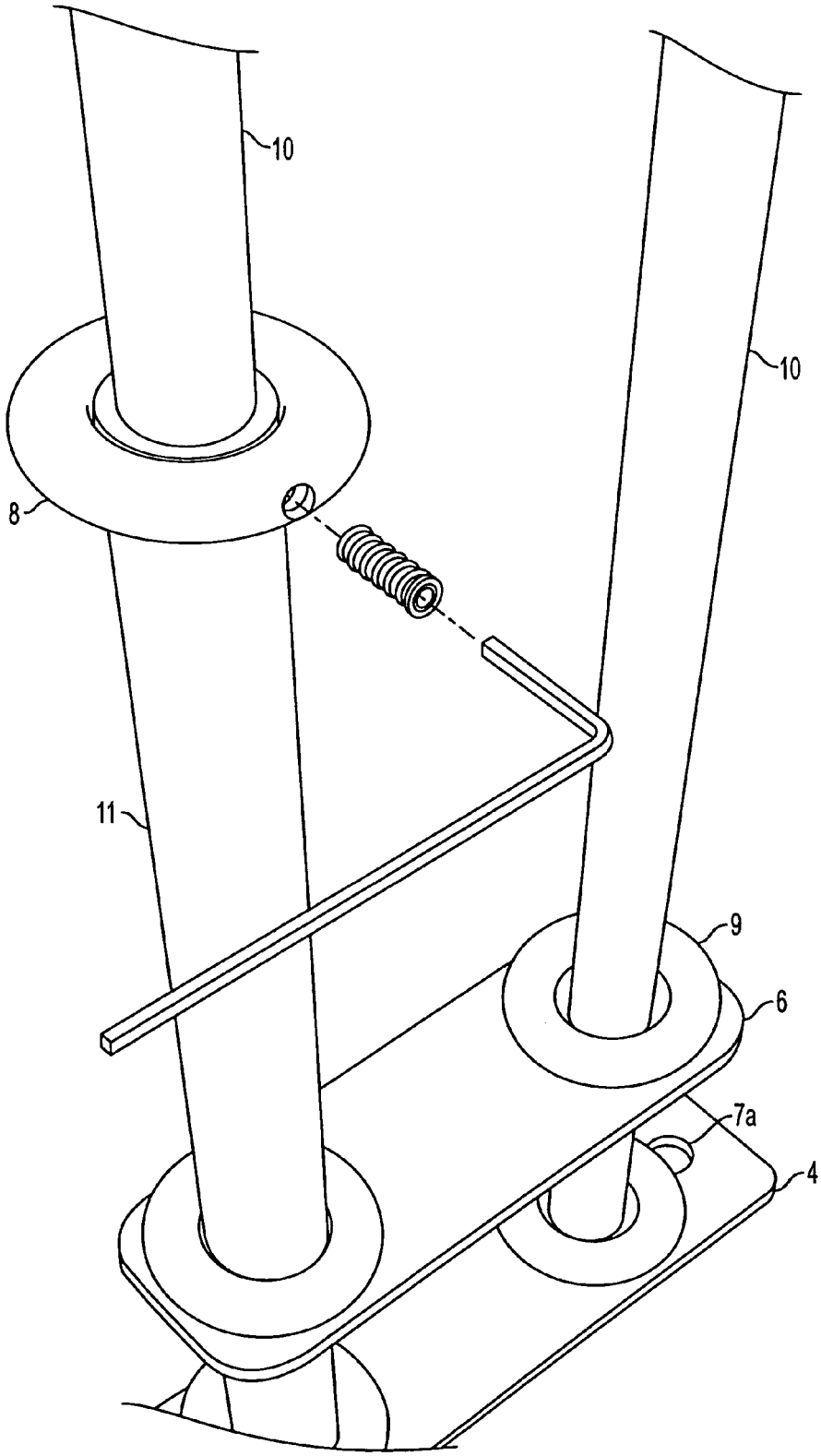
FIG. 7 is a perspective view depicting a means for fixing the adjustable security apparatus according to an illustrative, non-limiting embodiment of the present invention.

FIG. 7 depicts a coupling 8 which is used to secure the first portion 10 to the second portion 11 after the module has been extended and positioned within the window or door frame. As shown in FIG. 7, a non-limiting embodiment of the present invention uses a threaded hexagonal bolt than can be inserted using a standard hex wrench. In addition, other means for securing the first portion 10 to the second portion 11 are possible. For example, a key and lock can be used in conjunction with, or integrated in, the coupling 8 to secure the first portion 10 to the second portion 11. Clamps and other securing devices or fixing devices can also be used without departing from the scope of the present invention. Additional couplings 9, as shown in the Figures, can be used to secure the transverse plates to the posts or to provide added strength to the transverse plates 5, 6.

Figures 8A, 8B, 8C:
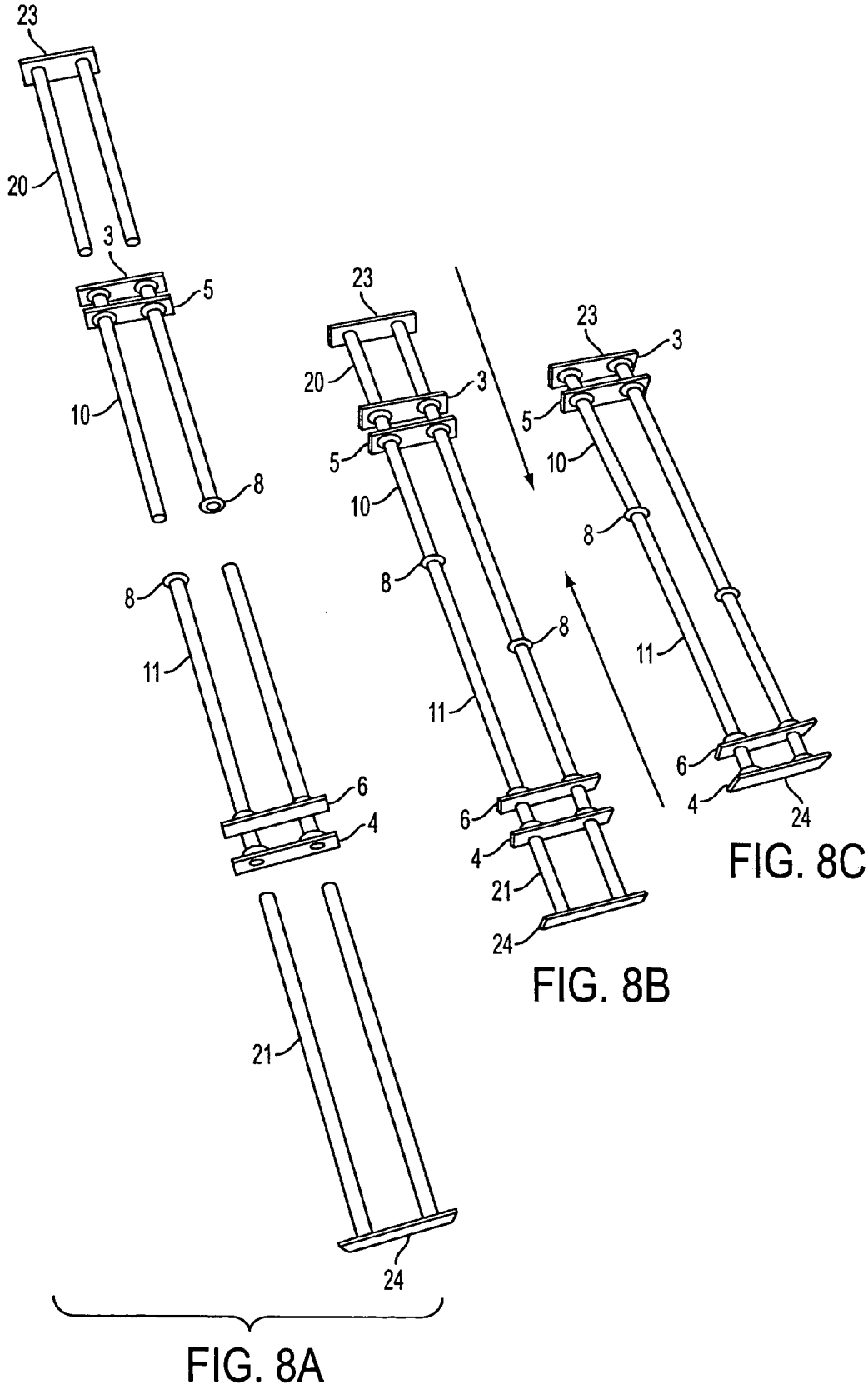
FIG. 8A-8C are perspective views depicting an adjustable security apparatus for protection of door and window openings further comprising a reinforcement member, where additional reinforcing members and end plates are used in an exploded view and an assembled view, according to yet another illustrative, non-limiting embodiment of the present invention.

In another illustrative embodiment of the adjustable security apparatus depicted in FIG. 8A, the module comprises additional reinforcement members 20, 21 disposed within the first portion 10 and the second portion 11 for reinforcing the module. The additional reinforcing members 20, 21 can be either hollow or solid. In this embodiment, the first portion 10 and second portion 11 which form the exterior portions, are hollow so that they can receive the additional reinforcing members 20, 21 in a telescopic manner, as shown in FIGS. 8B and 8C. The exterior portions can be formed from any material, such as plastic, metal, or composite materials. Moreover, as a result of the additional reinforcement members 20, 21 in this embodiment, the exterior portions are not required to have a high strength or rigidity, and therefore, a larger variety of materials are suitable for the exterior portions. As with the other embodiments of the present invention, the hollow exterior portions and the reinforcing members 20, 21 can be formed in various cross-sectional shapes, for example, circular or rectangular, so long as the module is capable of telescopically extending.

Moreover, as shown in FIGS. 8A-8C, another illustrative embodiment includes additional reinforcement end plates 23, 24, either alone or in combination with the additional reinforcing members 20, 21. These reinforcement end plates 23, 24 can take the place of, or be disposed within the end plates 3, 4.

Figure 9:
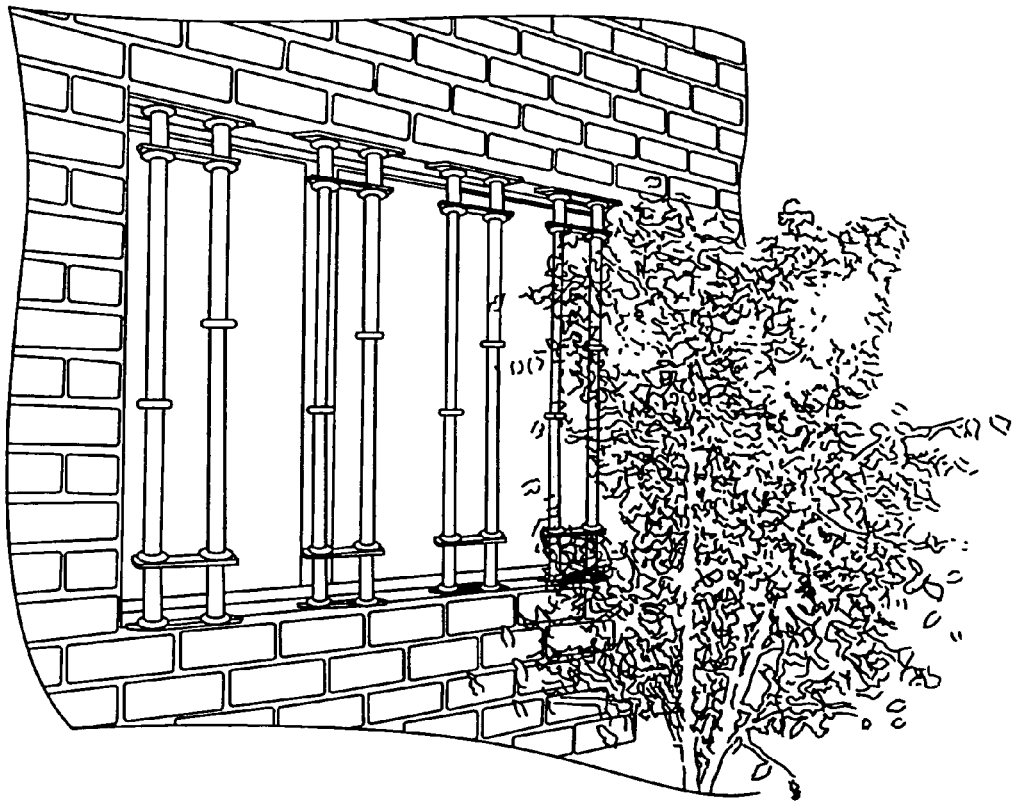
FIG. 9 is a perspective view depicting an adjustable security apparatus for protection of door and window openings installed on the exterior of a window frame, according to yet another illustrative, non-limiting embodiment of the present invention.
Figure 10:
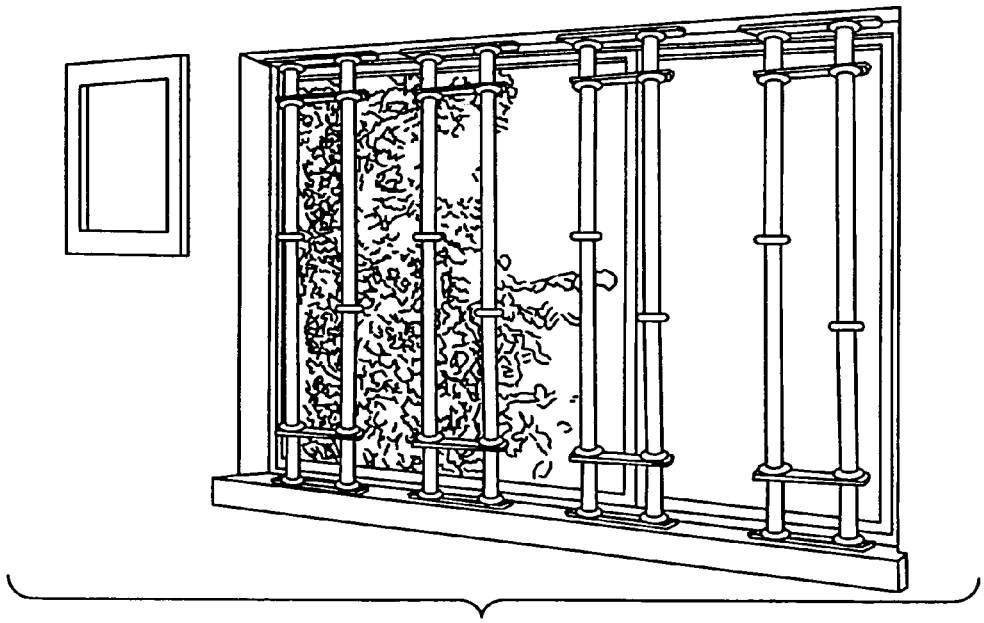
FIG. 10 is a perspective view depicting an adjustable security apparatus for protection of door and window openings installed on the interior of a window frame, according to still another illustrative, non-limiting embodiment of the present invention.

As shown in FIGS. 9 and 10, respectively, the above described illustrative embodiment of the adjustable security apparatus has the advantage that can it be installed inside or outside of the door or window. In addition, a plurality of modules 100 can be combined easily to span a wide range of door and window sizes. The telescopic vertical adjustability of the modules has the advantage of permitting easy application and adjustability to any size window or door opening. Furthermore, the modules 100 can also be installed in a horizontal position to provide increased flexibility and application to an even broader range of door and window opening sizes.

We claim:

1. A combination comprising:

a door or window opening having an upper frame and a lower frame, and an adjustable security apparatus for preventing entry through said door or window opening, said apparatus comprising:

a plurality of posts;

a first end plate non-moveably fixed to said posts for fastening a first end of said adjustable apparatus to the upper frame of said opening; and a second end plate non-moveably fixed to said posts for fastening a second end of said apparatus to the lower frame of said opening;

wherein each of said plurality of posts comprises:

a first portion having a predetermined length; and a second portion having a predetermined length;

wherein for each of said posts, said first portion is adapted to enter and telescopically engage said second portion, wherein a length of each of said plurality of posts telescopically adjusts to correspond to a longitudinal dimension between said upper frame and said lower frame of said opening, and wherein said first portion of at least a first one of said posts and said second portion of at least a second one of said posts are fixed to said first end plate and coupled together in parallel and form a first unit and at least said second portion of said first post and at least said first portion of said second post are fixed to said second end plate and coupled together in parallel and form a second unit;

further comprising a first horizontally extending plate and a first vertically extending plate, wherein the first horizontally extending plate connects the first post and the second post, the first vertically extending plate extends from the first horizontally extending plate to the first end plate; and the first vertically extending plate is entirely disposed between the first post and the second post.

2. The combination of claim 1, wherein said first portion and said second portion of at least one of said posts have a rectangular shape.

3. The combination of claim 1, wherein said first portion and said second portion of at least one of said posts have a square shape in cross section.

4. The combination according to claim 1, further comprising a reinforcing portion that is insertable into at least one of said first and second portions.

5. The combination of claim 1, wherein the shape of said first portions and the shape of said second portions of said plurality of posts are identical.

6. The combination of claim 1, wherein the shape of said first portions and the shape of said second portions of said plurality of posts are different.

7. The combination according to claim 1, further comprising a second horizontally extending plate and second vertically extending plate, wherein the second horizontally extending plate connects the first post and the second post, the second vertically extending plate extends from the second horizontally extending plate to the second end plate; and the second vertically extending plate is disposed between the first post and the second post.

8. The combination according to claim 7, wherein each of the first vertically extending plate and the second vertically extending plate includes slits, holes, grooves, or webbing.

9. The combination according to claim 1, wherein the first vertically extending plate includes slits, holes, grooves, or webbing.

* * * * *